United States Patent [19]

Goosman

[11] Patent Number: 4,896,579

[45] Date of Patent: Jan. 30, 1990

[54] FLUTE HEADJOINT

[76] Inventor: Jack P. Goosman, P.O. Box 13, Pickering, Ontario, L1V 2R2, Canada

[21] Appl. No.: 366,004

[22] Filed: Jun. 12, 1989

[51] Int. Cl.[4] ..... G10D 7/02

[52] U.S. Cl. ..... 84/384

[58] Field of Search ..... 84/380, 384

[56] References Cited

U.S. PATENT DOCUMENTS 3,062,084 11/1962 Ogilvie ..... 84/384

FOREIGN PATENT DOCUMENTS 837044 5/1952 Fed. Rep. of Germany ..... 84/384

*Primary Examiner*—Lawrence R. Franklin

*Attorney, Agent, or Firm*—Pennie & Edmonds

[57] ABSTRACT

A flute headjoint having superior playing characteristics, said headjoint comprising a lip plate coupled to a headjoint tube by means of a chimney, the lip plate, chimney bore and headjoint tube having apertures aligned to form an air passsageway, the lip plate and chimney forming an enbouchure wall having a top surface, a rear surface and a front surface which splits the stream of air from a flute player's lips into a first air stream which flows into the air passageway and a second air stream which flows over the top surface of the embouchure wall. The rear portion of the lip plate is shaped so as to channel the second air stream downwardly and towards the middle of the lip plates rear portion. Flutes fitted with such a headjoint are believed to have quicker attack, cleaner tonal qualities, and greater sound volume while retaining flexibility of play.

28 Claims, 2 Drawing Sheets

FLUTE HEADJOINT

FIELD OF THE INVENTION

The present invention relates to headjoints for flutes or piccolos, and in particular, to a flute headjoint having a lip plate.

BACKGROUND OF THE INVENTION

A flute headjoint is that portion of a flute or piccolo consisting of a length of tube which is closed at one end and attachable to the main body of the flute at the other end. A lip plate having a lip plate aperture or embouchure hole is mounted on the side of the headjoint tube via a short length of tube, called a chimney, extending between the underside of the lip plate and the side of the headjoint tube. The headjoint tube has an aperture in the side wall thereof which is aligned with the chimney bore and the lip plate aperture so as to form an air passageway between the lip plate aperture and the interior of the headjoint tube.

The lip plate of a conventional flute headjoint comprises a front portion located in front of the lip plate aperture, and a rear portion located behind the lip plate aperture and a downward extension of the lip plate called a skirt located along the edges of the lip plate. The flute player positions his lips on the front portion of the lip plate. The rear edge of the lip plate aperture and the rear inside wall of the chimney form an embouchure wall located opposite the flute player's lips. When a flute player plays the flute, the flute player blows a stream of air across the top surface of the lip plate aperture. The top edge of the embouchure wall divides the stream of air from the flute players lips into a primary air stream which travels into the body of the flute headjoint, and a secondary stream which passes across the rear portion of the lip plate. In a conventional flute, the secondary air stream travels across the rear portion of the lip plate in a fan-like pattern. This dispersion of the secondary air stream limits the sound volume produced by the flute and imparts certain undesirable tonal qualities to flute play.

Throughout history, the lip plates of flutes have undergone design modifications aimed at improving flute play. Some lip plates have been modified so as to adjust the positioning of a flute player's lips. Such modified lip plates involve changes to the front portion of the lip plate which often results in flute headjoints having restricted playing characteristics. These flute headjoints often have embouchure walls which are positioned higher relative to the flute player's lips as compared to ordinary headjoints, which produce peculiar tonal qualities and restricted playing characteristics.

Pompetzki (German Pat. No. 2407754) discloses a flute headjoint having a variable lip aperture. The Pompetzki headjoint uses a movable member mounted within the lip plate for opening or closing the lip plate aperture as desired. The Pompetzki headjoint does not change the path of the secondary air stream and, therefore, must suffer from the same drawbacks as other conventional flute headjoints.

SUMMARY OF THE INVENTION

The present invention overcomes the drawbacks associated with conventional flute headjoints by the provision of air channelling means which channel the secondary air stream downwardly and towards the center of the rear portion of the lip plate. In order to channel the secondary air stream, the rear portion of the lip plate in the present invention is divided into two lobes by a cleft. The forward most portion of the cleft is separated from the lip plate aperture by the top surface of the embouchure wall said top surface being continuous with the lip plate behind the lip plate aperture. The embouchure wall has a rear surface which may include a sloped face located between the two lobes.

During play, the secondary air stream travels across the top surface of the embouchure wall where it encounters the cleft. The secondary air stream travels within the cleft opening and down the sloped face of the rear surface of the embouchure wall. The lobes act to channel the secondary air stream towards the centre of the rear portion of the lip plate. The width and shape of the embouchure wall top surface, the shape and diameter of the cleft, the angle and shape of the sloped face, the symmetry of the lobes and the skirt around the edges of the lobes all influence the secondary air stream and impart certain desirable tonal characteristics to the flute headjoint.

Thus the present invention solves the problems associated with conventional flute headjoints without limiting the playing flexibility of the flute headjoint.

According to the invention, a flute headjoint comprises a tubular body having a lip aperture in the side wall thereof, lip positioning means for positioning a flute player's lips in front of the lip aperture, air splitting means for splitting the air stream from a flute player's lips into a first stream which travels through the lip aperture into the tubular body and a second air stream which travels past the lip aperture, and air chanelling means located behind the lip aperture for channelling the second air stream downwardly into a channel located behind the lip aperture.

The subject invention is also directed towards a flute headjoint comprising a headjoint tube having a tube aperture in its side wall, a flute chimney coupled to the headjoint tube, a lip plate having a lip plate aperture being coupled to the chimney, wherein the lip plate aperture, chimney bore and headjoint tube aperture are aligned to form an air passageway. The rear portion of the lip plate, located behind the lip plate aperture, is shaped so that the stream of air from the flute player's lips which passes fully across the lip plate aperture is channelled downwardly and towards the centre of the rear portion of the lip plate.

The subject flute headjoint lip plate may comprise a rear portion divided into two lobes by a cleft said cleft being separated from the lip plate aperture by the top surface of the embouchure wall, the top surface being a continuation of the lip plate behind the lip plate aperture. A skirt, being a downward extension of the lip plate, extends downwardly along the edges of the lip plate including the edges of the lobes. If the chimney used to mount the lip plate to the headjoint tube if relatively thick, a sloped face, being part of the rear surface of the embouchure wall, may be present between the lobes.

DETAILED DESCRIPTION OF THE INVENTION

In the following description of the invention and claims, the term "flute headjoint" refers to the headjoints of piccolos, flutes, alto flutes, bass flutes and the like.

Figure 1:
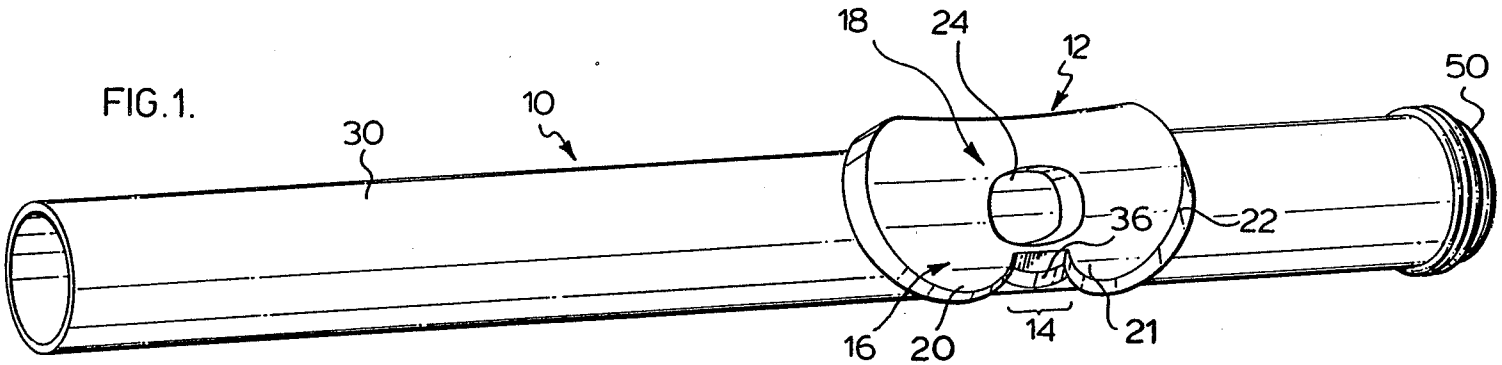
FIG. 1 is a perspective view of flute headjoint made in accordance with the subject invention.

Referring primarily to FIG. 1, the subject headjoint shown generally as 10 comprises lip plate 12 and headjoint tube 30. Headjoint tube 30 is open at one end and sealed at its other end by cap 50. Lip plate 12 is formed from a sheet of metal and is usually oblong in shape and arched to form a vault. Lip plate 12 is mounted on to chimney 36 which is in turn affixed to headjoint tube 30. Lip plate aperture 24 divides lip plate 12 into two portions, a front portion 18 located directly in front of lip plate aperture 24, and rear portion 16 located behind lip plate aperture 24. Lip plate rear portion 16 is divided into lobes 20 and 21 by cleft 14. Skirt 22 is a downward extension of lip plate 12 located along the edges thereof.

Figure 3:
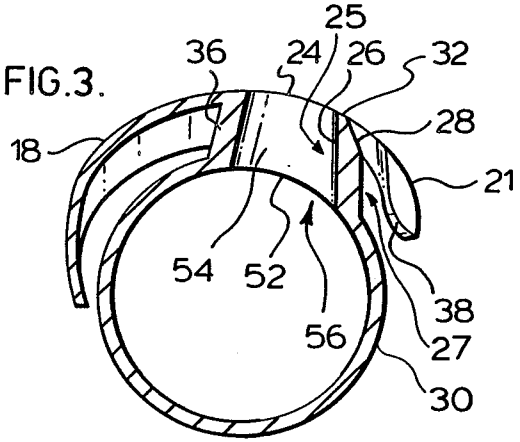
FIG. 3 illustrates a transverse sectional view between the lobes of the lip plate.
Figure 2:
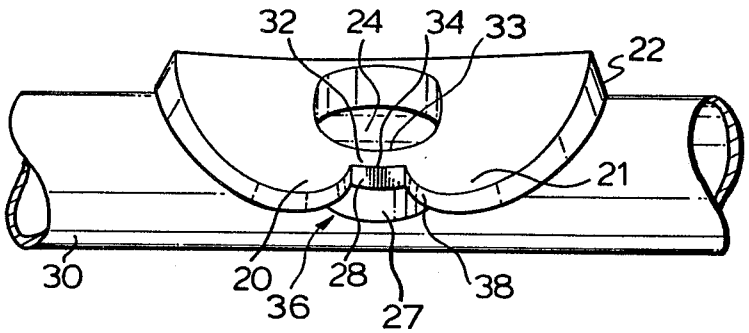
FIG. 2 illustrates an enlarged view of a portion of the flute headjoint shown in FIG. 1.

Referring to FIGS. 2 and 3, embouchure wall shown generally as 25 is formed by the lip plate 12 and the rear inside surface of chimney 36. Embouchure wall 25 includes a front surface 26, top surface 32 and rear surface 27. Front surface 26 is that portion of the surface of the inside wall of chimney 36 which receives the air stream emitted from a flute player's lips when the flute is being played. Embouchure wall top surface 32 is a narrow continuation of lip plate rear portion 16, which separates cleft 14 from lip plate aperture 24. The embouchure wall top surface has front edge 33 and a rear edge 34. The embouchure wall top surface 32 may vary in width between zero and two millimeters and may have a variety of shapes, as described hereinafter. Cleft 14 has a diameter of preferably between one to seven millimeters in flutes. For piccolos, the diameter of the cleft would be less, while for bass flutes and alto flutes the diameter of the cleft would be greater. Skirt extension 38 is a continuation of skirt 22 along lobes 20 and 21.

The blow hole shown generally as 56 is formed by lip plate aperture 24, chimney bore 54 and headjoint tube apertuure 52. Blow hole 56 is an air passageway connecting the interior of headjoint tube 30 with lip plate aperture 24.

Referring now primarily to FIG. 3, sloping face 28, located between lobes 20 and 21, is part of embouchure wall rear surface 27 and may be continuous with skirt extension 38. Sloping face 28 may have a variety of surface shapes. In the embodiment of the invention shown in FIGS. 2 and 3, sloping face 28 is flat while in other embodiments described hereinafter sloping face 28 may be either concave or convex. Sloping face 28 is set at an angle from the axis of the bore of the chimney.

Figure 4A:
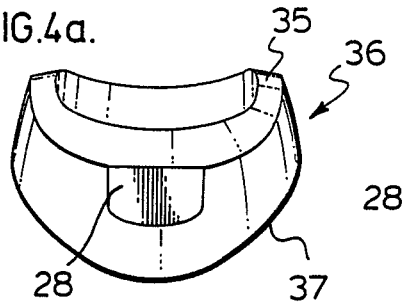
FIG. 4*a* is a perspective view showing the rear of the chimney section of the subject flute headjoint.
Figure 4B:
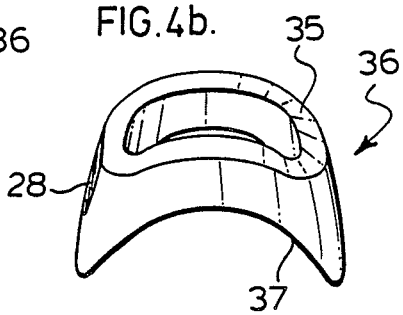
FIG. 4*b* is a perspective view showing the side of the chimney section of the subject flute headjoint.

With reference to FIGS. 4*a* and 4*b*, in one embodiment of the present invention, chimney 36 comprises a thick walled, truncated tube having top edge 35 and bottom edge 37, and sloping face 28. Top edge 35 serves to attach chimney 36 to the underside of lip plate 12. Bottom edge 37 serves to attach chimney 36 to tube body 30.

In playing a flute having a headjoint made in accordance with the subject invention, a flute player positions his lips upon the forward portion 18 of lip plate 12. The flute player then blows a stream of air tangentially across lip plate aperture 24. This air stream is divided by the front edge 33 of embouchure wall top surface 32 into a primary stream which flows down embouchure wall front surface 26 through blow hole 56 and a secondary stream which travels across embouchure wall top surface 32. In the case of a conventional flute headjoint, the secondary stream travels across the surface of rear portion 16 of lip plate 12 in a fan-like pattern. In the case of the present invention, however, the secondary air stream flows over the embouchure wall top surface 32 and then down into cleft 14. Lobes 20 and 21 as well as skirt extension 38 act to guide the secondary air stream down and towards the center of cleft 14.

The playing characteristics of the flute headjoint are determined by many factors. The width of the embouchure wall top surface 32, the diameter of cleft 14, the shape of rear edge 34 of embouchure wall top surface 32, the angle and shape of sloping face 28, the symmetry of lobes 20 and 21 as well as the shape of skirt extension 38 all affect the playing characteristics of the flute headjoint. The headjoint of the present invention is believed to have better sound volume, cleaner tonal qualities, and improved flexibility of play.

Figure 5A:
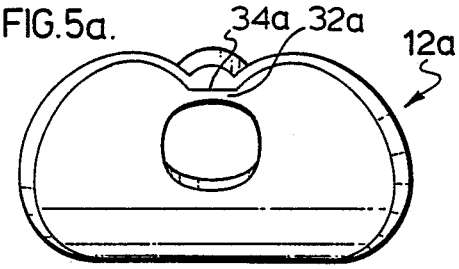
FIGS. 5*a* through 5*h* illustrates various possible alternative embodiments of the lip plate of the present invention.
Figure 5B:
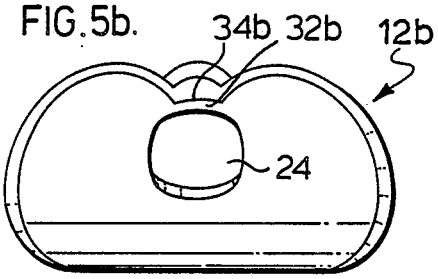
Figure 5C:
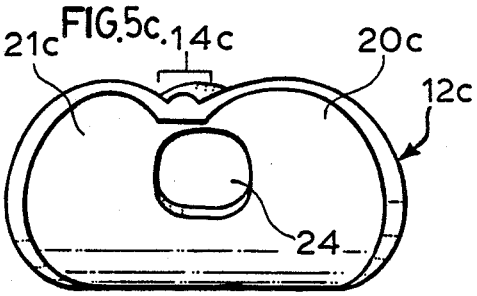
Figure 5D:
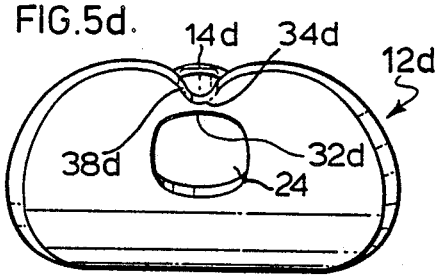
Figure 5E:
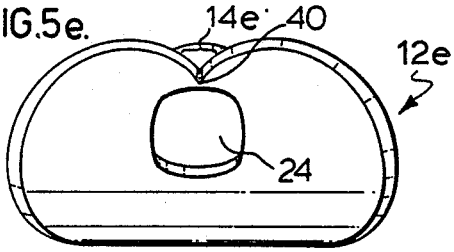
Figure 5F:
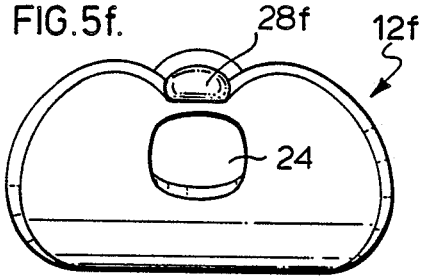
Figure 5G:
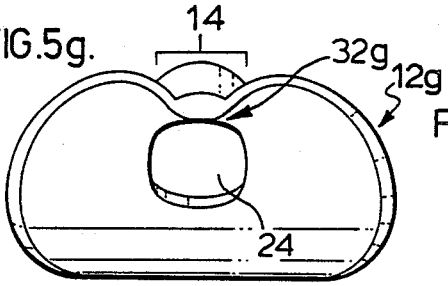
Figure 5H:
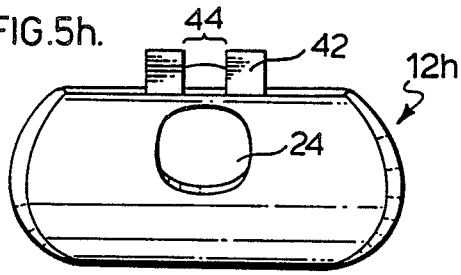

FIGS. 5*a* through 5*h*, illustrate a number of different embodiments of the subject invention. FIG. 5*a* illustrates one embodiment of the invention shown generally as 12*a*, wherein embouchure wall top surface 32*a* has a straight rear edge 34*a*. FIG. 5*b* illustrates another embodiment of the present invention shown generally as 12*b*, wherein rear edge 34*b* of embouchure wall top surface 32*b* is semicircular. FIG. 5*c* illustrates another embodiment of the present invention shown generally as 12*c*, wherein lobes 21*c* and 20*c* are asymmetric in size, lobe 21*c* being smaller than lobe 20*c*, and cleft 14*c* approaching lip plate aperture 24 towards one side thereof. FIG. 5*d* illustrates another embodiment of the present invention shown generally as 12*d*, wherein the forward most part of cleft 14*d* is rounded; in this embodiment of the present invention, rear edge 34*d* of embouchure wall top surface 32*d* is arched and extension 38*d* of skirt 22 is continuous. FIG. 5*e* illustrates another embodiment of the present invention shown generally as 12*e*, wherein cleft 14*e* is V-shaped, the forward most point 40 of cleft 14*e* approaches lip plate aperture 24. FIG. 5*f* illustrates another embodiment of the present invention shown generally as 12*f*, wherein sloping face 28*f* is concave. A concaved sloping face 28*f* may be achieved by milling down sloping face 28 with a circular cutter. FIG. 5*g* illustrates another embodiment of the present invention shown generally as 12*g*, wherein embocuhure wall top surface 32*g* is very narrow so that cleft 14 touches lip plate aperture 24. FIG. 5*h* discloses another embodiment of the present invention shown generally as 12*h*, wherein the rear portion of lip plate 12*h* has been removed almost entirely and tabs 42 have been coupled to the rear most portion of lip plate 12*h*. Gap 44 separates tabs 42 and functions similarly as cleft 14 in the preferred embodiment of the present invention.

The present invention is also directed at piccolos or flutes having thick-walled wooden headjoints which do not require lip plates. In such headjoints, the side wall of the body of the flute headjoint has a lip aperture which forms an air passageway into the body of the flute. A front portion for positioning a flute player's lips is located in front of the lip aperture and a rear portion is located behind. The inside surface of the lip aperture located opposite the flute player's lips forms an embouchure wall which functions in the same manner as the embouchure wall in a metallic flute headjoint. The headjoint is modified in accordance with the subject invention by a hollow which is created by removing an area of wood behind the lip aperture so as to form a pair of lobes shaped like the lobes of lip plate 12.

Many changes could be made in the above disclosed apparatus without departing from the scope thereof. It is therefore intended that all matter contained in the above description, or shown in the accompanying drawings, shall be interpreted as being illustrative only and not limiting.

I claim:

1. A flute headjoint, comprising:

(a) a tubular body and a lip aperture in the side wall thereof;

(b) lip positioning means located in front of the lip aperture for positioning a flute player's lips;

(c) air splitting means for splitting the stream of air from a flute player's lips into a first air stream which travels through the lip aperture into the tubular body and a second air stream which travels past the lip aperture; and (d) air channelling means located behind the lip aperture shaped for channelling the second air stream downwardly into a channel located behind the lip aperture.

2. A flute headjoint, comprising:

(a) a headjoint tube having a tube aperture in the side wall thereof;

(b) a flute chimney coupled to the side wall of the tube having a chimney bore in alignment with the tube aperture;

(c) a lip plate mounted onto the flute chimney having a lip plate aperture in alignment with the chimney bore;

(d) wherein the lip plate aperture, chimney bore and tube aperture together form an air passageway into the interior of the headjoint tube and an embouchure wall having a front surface, a rear surface and a top surface, which splits the air coming from the flute player's lips into a first air stream which flows into the air passageway and a second air stream which flows over the top surface of the embouchure wall; and (e) wherein the lip plate comprises a front portion for positioning the lips of the flute player relative to the lip plate aperture and a back portion extending beyond the front surface of the embouchure wall, the back portion of the lip plate being shaped so as to channel the second air stream downwardly and away from the sides and towards the middle of the back portion of the lip plate.

3. The headjoint defined in claim 2, wherein the back portion of the lip plate is divided into two lobes by a cleft located behind the lip plate aperture.

4. The headjoint defined in claim 3, wherein the width of the cleft is between about 10% and about 75% of the diameter of the lip plate aperture.

5. The headjoint defined in claim 3, wherein the top surface of the embouchure wall is continuous with the rear portion of the lip plate, said embouchure wall top surface separating the lip plate aperture from the cleft, said embouchure wall top surface having a rear edge opposite the lip plate aperture.

6. The headjoint as defined in claim 5, wherein the embouchure wall top surface is between zero and two millimeters in width.

7. The headjoint as defined in claim 5, wherein the forward most portion of the cleft is rounded and the rear edge of the embouchure wall top surface is arched.

8. The headjoint as defined in claim 5, wherein the rear edge of the embouchure wall top surface is straight.

9. The flute headjoint as defined in claim 5, wherein the rear surface of the embouchure wall includes a sloping face located between the lobes.

10. The headjoint as defined in claim 9, wherein the sloping face is concave.

11. The headjoint as defined in claim 9, wherein the sloping face is convex.

12. The headjoint as defined in claim 9, wherein the sloping face is flat.

13. The headjoint as defined in claim 9, wherein the extensions of the skirt along the edges of the lobes meets the sloping face.

14. The flute headjoint as defined in claim 3, wherein the lobes are symmetric.

15. The headjoint as defined in claim 3, wherein the lobes are asymmetric.

16. The headjoint as defined in claim 3, wherein the cleft is pointed, the forward most extension of the cleft approaching the lip plate aperture at one point.

17. The headjoint as defined in claim 3, further comprising a skirt located at the edges of the lip plate, said skirt being a downward extension of the lip plate, wherein the skirt extends along the edges of the lobes.

18. A lip plate adapted to be mounted onto a flute headjoint tube having a tube aperture in the side wall thereof by means of a flute chimney having a chimney bore in alignment with the tube aperture, the said lip plate comprising a front portion, a rear portion, a skirt portion extending downwardly around the edges of the lip plate, and a lip plate aperture, said lip plate and chimney forming an embouchure wall located so as to receive an airstream from a flute player's lips, the said embouchure wall having a front surface, a rear surface and a top surface, wherein the rear portion of the lip plate is divided into two lobes by a cleft which is separated from the rear edge of the lip plate aperture by the embouchure wall top surface, said top surface being continuous with the rear portion of the lip plate, the said lobes being a continuation of the rear portion of the lip plate.

19. A flute headjoint having a tubular body and a lip plate, said lip plate having an oblong vault shape, said lip plate having a lip plate aperture, a front portion for the positioning of a flute player's lips located in front of the lip plate aperture, a rear portion located behind the lip plate aperture, and a skirt, said skirt being a downward extension of the lip plate along the outside edges of the lip plate, the lip plate being coupled to one end of a tubular chimney having a chimney bore in alignmet with the lip plate aperture, said chimney being coupled to the tubular body of a flute headjoint, the flute headjoint having an aperture in its side wall aligned with the bore of the chimney, said lip plate and chimney forming an embouchure wall positioned so as to receive the air coming from a flute player's lips when the flute is being played, said embouchure wall having a front surface, a top surface and a rear surface, the improvement in combination therewith comprising the rear portion of the lip plate being divided into two lobes by a cleft, the cleft being separated from the lip plate aperture by the embouchure wall top surface, the said top surface being continuous with the rear portion of the lip plate and having a rear edge, said lobes being a continuation of the rear portion of the lip plate following the general arch of the lip plate, the skirt extending along the edges of the said lobes.

20. The flute headjoint as defined in claim 19, wherein the cleft extends inwardly towards the lip plate aperture in a V-shape, the point of the V-shaped cleft being closest to the lip plate aperture.

21. The lip plate as defined in claim 19, wherein the rear edge of the embouchure wall top surface is semicircular.

22. The flute headjoint as defined in claim 19, wherein the forward most portion of the cleft is rounded such that the rear edge of the embouchure wall top surface is arched.

23. The flute headjoint as defined in claim 19, wherein the rear edge of the embouchure wall top surface is straight.

24. The flute headjoint as defined in claim 19, further comprising a sloping face located between the lobes, said sloping face being part of the embouchure wall rear surface and set at an angle from the vertical line through the chimney bore, wherein the skirt along the edges of the lobes contacts the sloping face.

25. The flute headjoint as defined in claim 24, wherein the sloping face is concave.

26. The flute headjoint as defined in claim 24, wherein the sloping face in convex.

27. The flute headjoint as defined in claim 24, wherein the sloping face is flat.

28. The flute headjoint as defined in claim 19, wherein the rear portion of the lip plate is very narrow, a pair of tab like structures being attached behind the lip plate aperture, said tab like structure being separated by a gap.

* * * * *